US009802086B2

(12) United States Patent
Kato

(10) Patent No.: US 9,802,086 B2
(45) Date of Patent: Oct. 31, 2017

(54) GOLF CLUB HEAD

(71) Applicant: DUNLOP SPORTS CO. LTD., Kobe-shi, Hyogo (JP)

(72) Inventor: Masatoshi Kato, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/173,068

(22) Filed: Jun. 3, 2016

(65) Prior Publication Data

US 2016/0354655 A1 Dec. 8, 2016

(30) Foreign Application Priority Data

Jun. 5, 2015 (JP) ..... 2015-115331

(51) Int. Cl.
*A63B 53/04* (2015.01)
*A63B 60/52* (2015.01)

(52) U.S. Cl.
CPC ..... *A63B 53/0466* (2013.01); *A63B 60/52* (2015.10); *A63B 2053/0433* (2013.01)

(58) Field of Classification Search
CPC ..... A63B 53/04
See application file for complete search history.

(56) References Cited

U.S. PATENT DOCUMENTS 5,154,424 A * 10/1992 Lo ..... A63B 53/04 473/338
5,251,901 A * 10/1993 Solheim ..... A63B 53/04 473/338
5,582,553 A * 12/1996 Ashcraft ..... A63B 53/04 473/338
7,435,191 B2 * 10/2008 Tateno ..... A63B 53/0466 473/346
9,174,103 B2 * 11/2015 Curtis ..... A63B 53/08
2006/0172818 A1 * 8/2006 Yamamoto ..... A63B 53/0466 473/345
2010/0022327 A1 1/2010 Nakano
(Continued)

FOREIGN PATENT DOCUMENTS

JP 2002-315855 A 10/2002
JP 2006-204604 A 8/2006
(Continued)

OTHER PUBLICATIONS

Japanese Office Action for JP 2014-115331 and its English translation dispatched on Oct. 20, 2015.
(Continued)

*Primary Examiner* — Michael Dennis
(74) *Attorney, Agent, or Firm* — Birch, Stewart, Kolasch & Birch, LLP

(57) ABSTRACT

Provided is a golf club head in which the lateral moment of inertia can be increased through thickness adjustment of the sole portion. The golf club head according to the present invention includes a crown portion, a sole portion and a face portion. The sole portion includes a first thin-walled portion and a first thick-walled portion that extends from the toe side of the first thin-walled portion to the heel side of the first thin-walled portion via the back side, so as to surround the first thin-walled portion, and is thicker than the first thin-walled portion.

14 Claims, 4 Drawing Sheets

(56) References Cited

U.S. PATENT DOCUMENTS

| | | | | |
|---|---|---|---|---|
| 2010/0151963 | A1* | 6/2010 | Meyer | A63B 53/0466<br>473/345 |
| 2012/0302368 | A1* | 11/2012 | Nishio | A63B 53/04<br>473/345 |
| 2014/0106903 | A1* | 4/2014 | Nakamura | A63B 53/0466<br>473/346 |

FOREIGN PATENT DOCUMENTS

| | | | |
|---|---|---|---|
| JP | 2010-029358 | A | 2/2010 |
| JP | 2013-132484 | A | 7/2013 |
| JP | 2014-079447 | A | 5/2014 |

OTHER PUBLICATIONS

Japanese Office Action for JP 2014-115331 and its English translation dispatched on Sep. 1, 2015.

* cited by examiner

Cross-section E1

GOLF CLUB HEAD

CROSS REFERENCE TO RELATED APPLICATION

This application claims a priority to Japanese Patent Application No. 2015-115331 filed on Jun. 5, 2015, which is hereby incorporated by reference in its entirety.

FIELD OF INVENTION

The present invention relates to a golf club head.

BACKGROUND OF THE INVENTION

Wood-type golf club heads have heretofore undergone many improvements, and various proposals have been made in order to increase carry distance. For example, in JP 2014-79447A, a thick-walled portion is provided in the sole portion, and the center of gravity and lateral moment of inertia of the head are adjusted.

However, it is not easy to adjust the position of the center of gravity and the lateral moment of inertia through thickness adjustment of the sole portion, and there are calls to, in particular, increase the lateral moment of inertia through thickness adjustment. The present invention was made in order to solve the above problem, and an object of the invention is to provide a golf club head in which the lateral moment of inertia can be increased through thickness adjustment of the sole portion.

SUMMARY OF INVENTION

A golf club head according to the present invention includes a crown portion, a sole portion, and a face portion. The sole portion includes a first thin-walled portion and a first thick-walled portion that extends from a toe side of the first thin-walled portion to a heel side of the first thin-walled portion via a back side, so as to surround the first thin-walled portion, and is thicker than the first thin-walled portion.

The above golf club head can be configured such that the first thick-walled portion is at least partially larger in width on the heel side than on the toe side.

Each of the above golf club heads can be configured such that the first thick-walled portion is formed to have a substantially U-shape projecting to the back side.

Each of the above golf club heads can be configured such that the sole portion further includes a second thick-walled portion that is arranged on a face side of the first thin-walled portion.

Each of the above golf club heads can be configured such that the sole portion further includes a second thin-walled portion that is arranged on the back side of the first thick-walled portion, so as to surround the first thick-walled portion, and is thinner than the first thick-walled portion.

Each of the above golf club heads can be configured such that the golf club head is constituted by assembling a head body and a face member. The head body includes the crown portion and the sole portion, and has an opening surrounded by the crown portion and the sole portion. The face member is formed in a cup shape having the face portion which is tabular and is for hitting a ball and a peripheral portion that extends from a peripheral edge of the face portion and is joined to an end surface of the opening.

A golf club head according to an one aspect of embodiment enables the lateral moment of inertia to be increased through thickness adjustment.

DETAILED DESCRIPTION OF THE PREFERRED EMBODIMENTS

Figure 1:
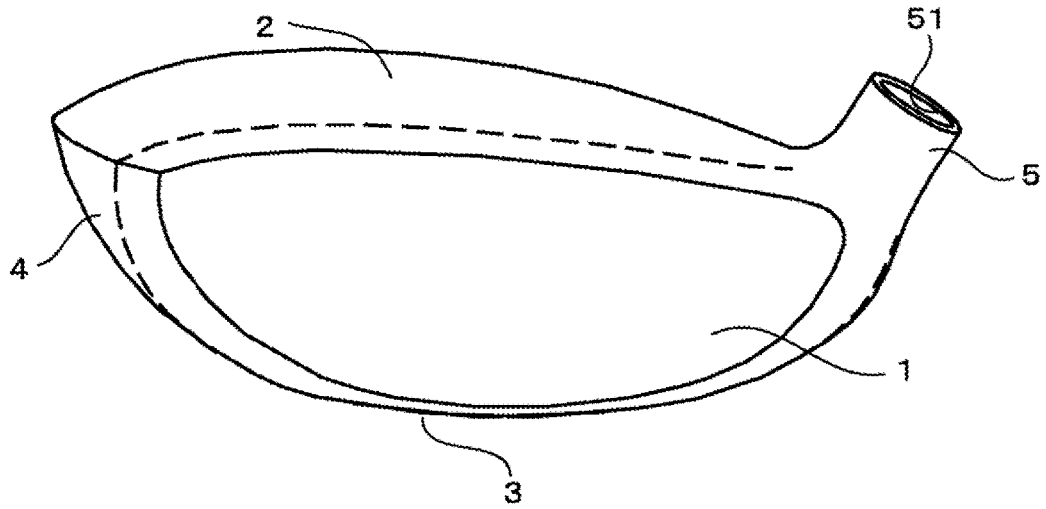
FIG. 1 is a perspective view of a reference state of a golf club head according to an embodiment.
Figure 2:
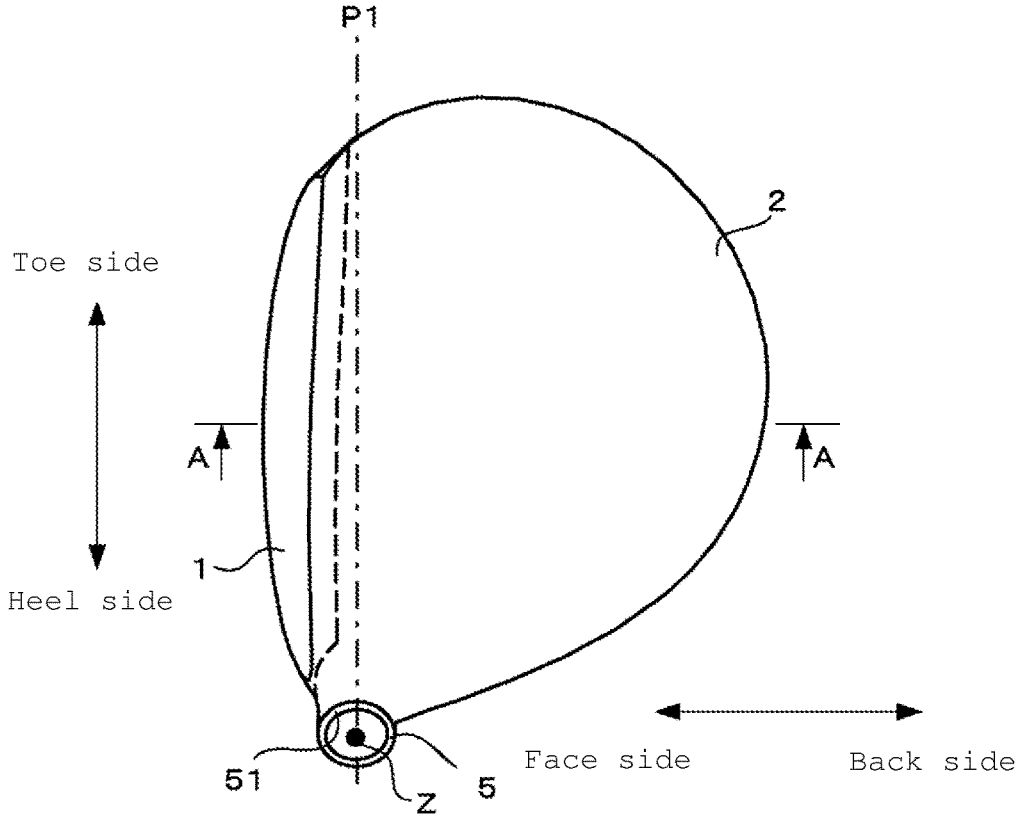
FIG. 2 is a plan view of FIG. 1.

Hereinafter, one embodiment of a golf club head according to the present invention will be described, with reference to the drawings. FIG. 1 is a perspective view of a reference state of a golf club head according to the present embodiment, and FIG. 2 is a plan view of FIG. 1. Note that the reference state of the golf club head will be discussed later.

1. Overview of Golf Club Head

As shown in FIG. 1, the golf club head according to the present embodiment (hereinafter, may be simply referred to as the "head") is a wood-type golf club head having a hollow structure and wall surfaces formed by a face portion 1, a crown portion 2, a sole portion 3, a side portion 4, and a hosel portion 5.

The face portion 1 is the surface that hits the ball, and the crown portion 2 is adjacent to the face portion 1 and constitutes the upper surface of the head. The sole portion 3 constitutes the bottom surface of the head, and is adjacent to the face portion 1 and the side portion 4. A weight member (illustration omitted) is arranged in the sole portion 3. Also, the side portion 4 is the region between the crown portion 2 and the sole portion 3, and extends from the toe side of the face portion 1 to the heel side of the face portion 1 across the back side of the head. Furthermore, the hosel portion 5 is the region that is provided adjacent to the heel side of the crown portion 2, and has an insertion hole 51 for the shaft (illustration omitted) of the golf club to be inserted. A central axis Z of this insertion hole 51 coincides with the axis of the shaft.

Here, the above-mentioned reference state will be described. First, as shown in FIG. 2, a state in which the central axis Z is in a plane P1 that is perpendicular to a horizontal surface H (placement surface; see FIG. 5) and the head is placed on the horizontal surface H at a predetermined lie angle and real loft angle is prescribed as the reference state. The plane P1 will be referred to as a reference vertical plane P1. Also, as shown in FIG. 2, the direction of the line of intersection of the reference vertical plane P1 and the horizontal surface H will be referred to as the toe-heel direction, and the direction that is perpendicular to the toe-heel direction and parallel to the horizontal surface H will be referred to as the face-back direction. Also, a cross-section taken along the line A-A in FIG. 2 is a vertical plane passing through the center of the face (plane perpendicular to the above-mentioned horizontal surface H; the same applies below). Note that the center of the face is a point within the face portion 1 at which the horizontal length from that point to a position furthest on the toe side of the face portion 1 is equal to the horizontal length from that point to a position furthest on the heel side of the face portion 1, and the length in the up-down direction from that point to a position furthest on the upper side of the face portion 1 is equal to the length in the up-down direction from that point to a position furthest on the lower side of the face portion 1.

Figure 3A:
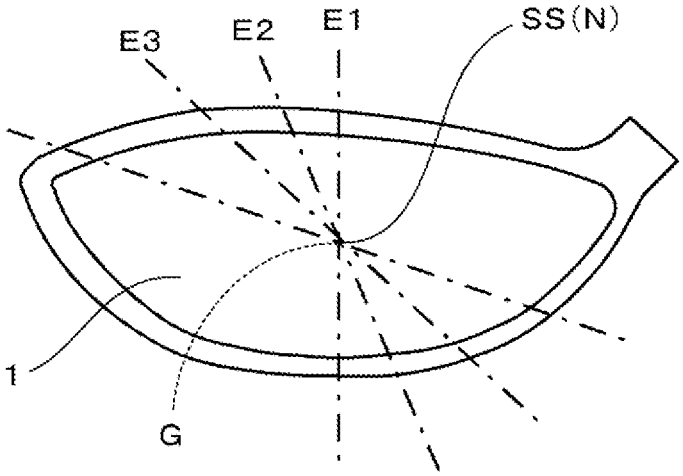
FIGS. 3A and 3B are diagrams illustrating a boundary of a face portion.
Figure 3B:
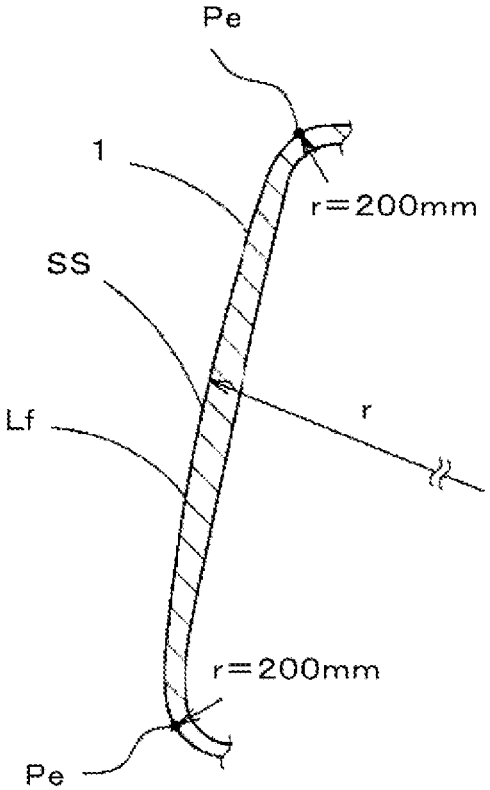

In the present embodiment, the boundary between the crown portion 2 and the side portion 4 can be defined as follows. That is, if a ridge line is formed between the crown portion 2 and the side portion 4, that ridge line serves as the boundary. In contrast, if a clear ridge line is not formed, the outline that is seen when the head is placed in the reference state and viewed from directly above the center of gravity of the head serves as the boundary. This similarly applies to the boundary between the crown portion 2 and the face portion 1, and thus if a ridge line is formed, that ridge line serves as the boundary. However, if a clear ridge line is not formed, positions Pe where, in cross-sections E1, E2, E3 and so on that include a straight line N connecting a center of gravity G of the head and a sweet spot SS, as shown in FIG. 3A, for example, a radius of curvature r of an outline Lf of the outer surface of the face first reaches 200 mm when moving outward from the sweet spot side, as shown in FIG. 3B, is defined as the peripheral edge (boundary) of the face portion 1. Note that the sweet spot SS is the intersection between the face surface and the normal (straight line N) of the face surface that passes through the center of gravity G of the head.

Also, in the present embodiment, the boundary between the sole portion 3 and the face portion 1 and between the sole portion 3 and the side portion 4 can be defined as follows. That is, if a ridge line is formed between the sole portion 3 and the face portion 1 and between the sole portion 3 and the side portion 4, that ridge line serves as the boundary. Also, although the golf club head according to the present embodiment has the side portion 4, in cases such as where, for example, the side portion is not provided, the side portion 4 cannot be clearly distinguished and is included in the sole portion, or the sole portion 3 is directly connected to the crown portion 2, the ridge line between the sole portion 3 and the crown portion 2 serves as the boundary between both portions. Also, if a clear ridge line is not formed, the outline that is seen when the head is placed in the reference state and viewed from directly above the center of gravity of the head serves as the boundary. Note that, in consideration also of the case where the side portion cannot be clearly distinguished as described above, the "sole portion" according to the present invention is deemed to include the side portion.

The volume of this golf club head is, for example, preferably 90 $cm^3$ or more, and more preferably 100 $cm^3$ or more. A head having such a volume serves to make the golfer feel more confident when the club is held at address, and also to increase the sweet spot area and the moment of inertia. Note that although an upper limit of the head volume is not particularly defined, in terms of practical use, it is, for example, desirably 200 $cm^3$ or less, and desirably 460 $cm^3$ or less in the case of complying with R&A and USGA rules and regulations.

Also, the head can be formed from, for example, maraging steel having a specific gravity of approximately 7.7 to 7.8. Apart from maraging steel, the head can also be formed using one or a plurality of materials selected from among stainless steel, a titanium alloy, an aluminum alloy, a magnesium alloy, an amorphous alloy, and the like.

2. Assembly Structure of Golf Club Head

Figure 4:
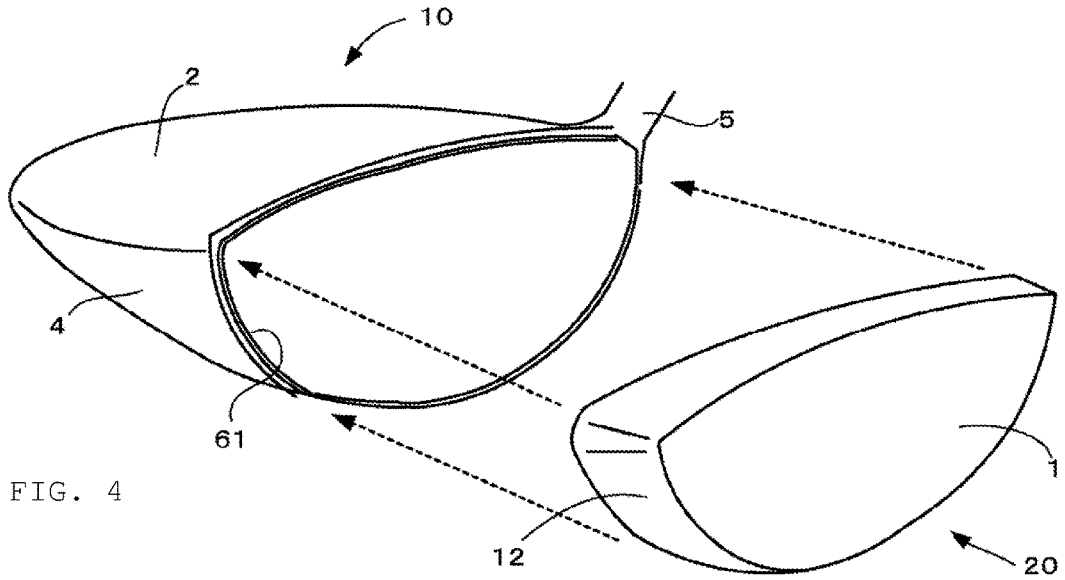
FIG. 4 is a perspective view illustrating assembly of the golf club head shown in FIG. 1.

The head according to the present embodiment is, as shown in FIG. 4, constituted by assembling a head body 10 having the crown portion 2, the sole portion 3 and the side portion 4 and a face member 20 formed in a cup shape that has the face portion 1 and a peripheral portion 12 extending from the periphery of the face portion 1. This head body 10 has an opening surrounded by the crown portion 2, the sole portion 3 and the side portion 4, and the face member 20 is attached so as to close this opening 61. That is, the end surface of the peripheral portion 12 of the face member 20 is butted against the end surface of the opening 61, and these two portions are joined by welding as will be discussed later. The face member 20, by being attached to the opening of the head body 10, is integrated with the head body 10, and the peripheral portion 12 of the face member 20 thereby functions as a part of the crown portion 2, the sole portion 3, and the side portion 4. Accordingly, the surfaces that are integrally formed by the peripheral portion 12 of the face member 20 being attached to the head body 10 constitute the crown portion 2, the sole portion 3, and the side portion 4. Although the various portions of the head body 10 are thus, strictly speaking, a part of these surfaces, the portions of the head body 10 may be referred to below as the crown portion 2, the sole portion 3 and the side portion 4, without making this distinction.

3. Structure of Face Member

Figure 5:
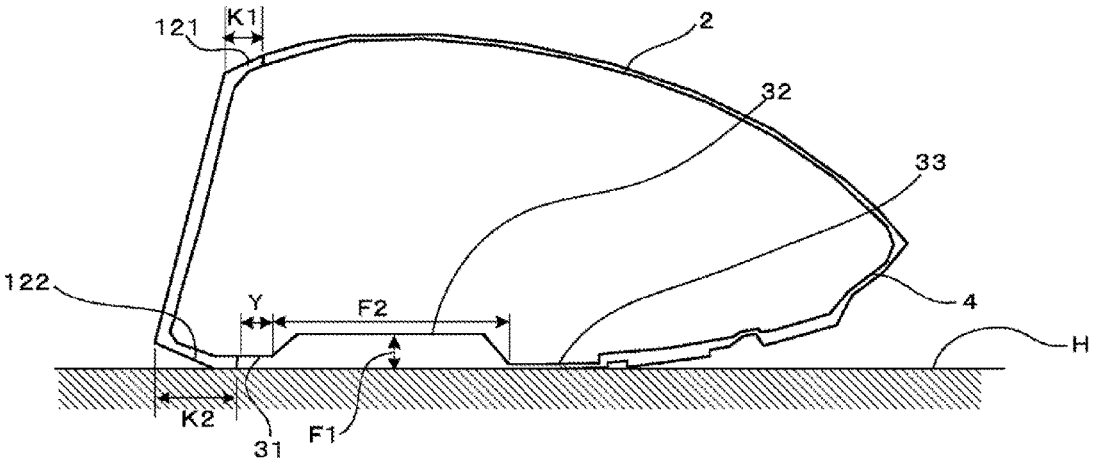
FIG. 5 is a cross-sectional view taken along the line A-A in FIG. 2.

Next, the peripheral portion 12 of the face member 20 will be described, with reference to FIG. 5. FIG. 5 is a cross-sectional view taken along the line A-A in FIG. 2 mentioned above. As described above, the face member 20 is formed in a cup shape that has the face portion 1 and the peripheral portion 12 extending from the periphery of the face portion 1. A width K1 of the part of the peripheral portion 12 that is joined to the crown portion 2 of the head body 10, or in other words, the protruding length thereof from the face portion 1, is preferably 3 to 8 mm, and is more preferably 4 to 7 mm. On the other hand, a width K2 of the part of the peripheral portion 12 that is joined to the sole portion 3 of the head body 10 is preferably larger than 8 mm and 15 mm or less, and is more preferably 9 to 12 mm. Hereinafter, the part of the peripheral portion 12 that is joined to the crown portion 2 will be referred to as a first peripheral region 121, and the part that is joined to the sole portion 3 will be referred to as a second peripheral region 122. Also, the widths K1 and K2 of the first peripheral region 121 and the second peripheral region 122 are assumed to be measured by the length in the face-back direction in the case where the head body 10 is cut in a vertical plane passing through the above-mentioned center of the face.

As described above, in the present embodiment, the width K2 of the second peripheral region 122 is larger than the width K1 of the first peripheral region 121, and, in particular, is preferably more than 1.6 times larger, and more preferably 1.8 or more times larger.

4. Structure of Sole Portion

Figure 6:
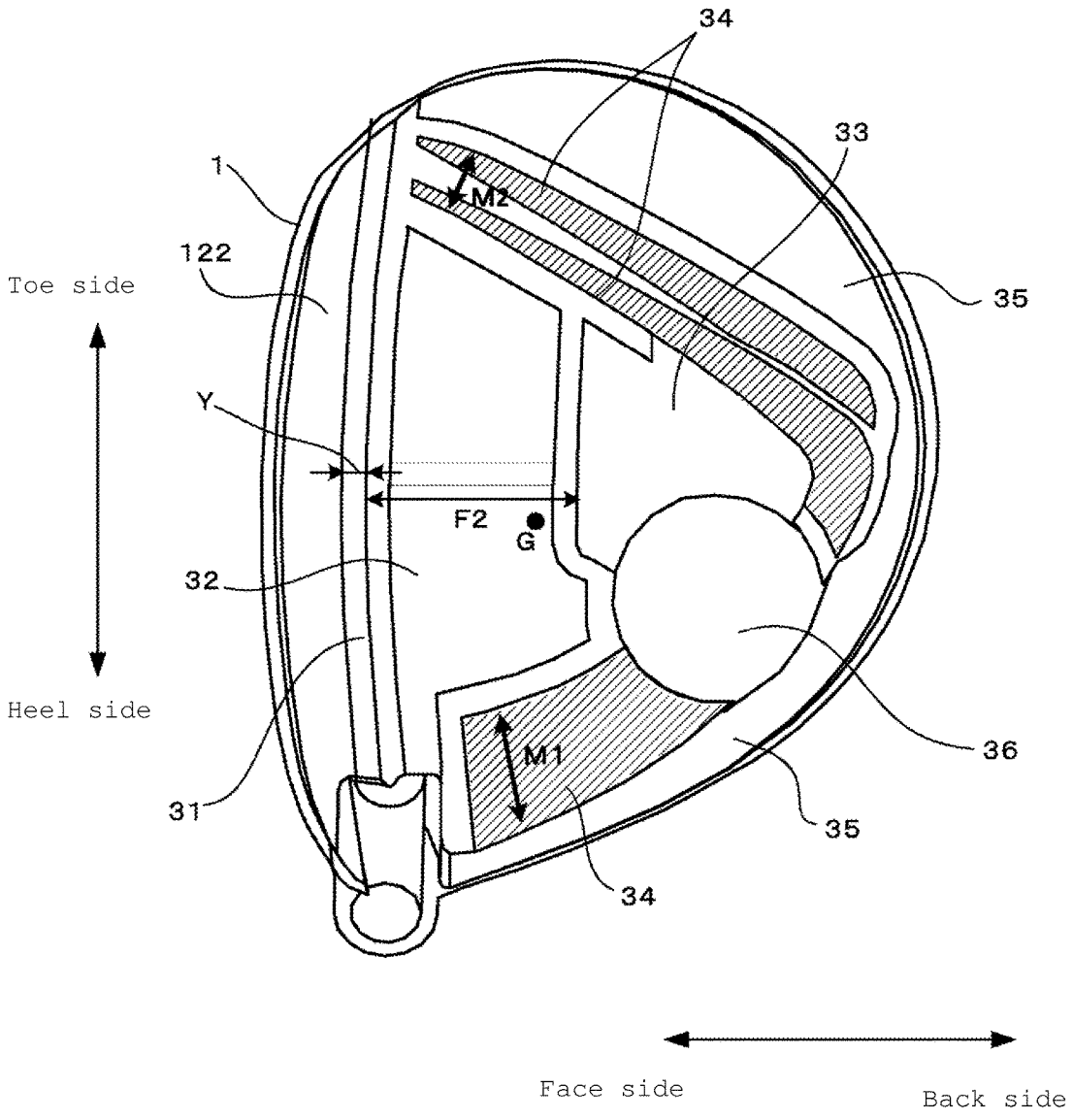
FIG. 6 is a plan view that projects the inner wall surface of a sole portion of the golf club head of FIG. 1.

Next, the sole portion 3 will be described, with reference also to FIG. 6. FIG. 6 is a plan view that penetrates the inner wall surface of the sole portion. As shown in FIGS. 5 and 6, the sole portion 3 is provided with a joining portion 31 that joins to the peripheral portion 12 of the face member 20, a frontal thick-walled portion (second thick-walled portion) 32 that is arranged on the back side of the joining portion 31, and a central thin-walled portion (first thin-walled portion) 33 that is arranged on the back side of this frontal thick-walled portion 32. Also, a peripheral thick-walled portion (first thick-walled portion) 34 arranged so as to surround the frontal thick-walled portion 32 and the central thin-walled portion 33 is provided in the sole portion 3, and a peripheral thin-walled portion (second thin-walled portion) 35 is furthermore arranged so as to surround this peripheral thick-walled portion 34. Also, the peripheral thick-walled portion 34 has arranged therein a recessed portion 36 in which the above-mentioned weight member is to be arranged.

The thickness of the joining portion 31 is generally the same as the thickness of the end surface of the peripheral portion 12 of the face member 20, and can, for example, be set from 0.7 to 1.5 mm. The same also applies to the side portion 4 and the crown portion 2. A width Y of the joining portion 31 in the face-back direction is preferably 10 mm or less, and is more preferably 5 mm or less. This is because if the width Y of the joining portion is too long, the frontal thick-walled portion 32 will be arranged further on the back side, possibly resulting in the center of gravity being shifted to the back side. In particular, the SS (sweet spot) height is raised and the ball hitting angle is lowered when the center of gravity shifts to the back side. Conversely, welding is difficult when the width Y of the joining portion is too short, and thus the width Y is preferably 2.5 mm or more.

The frontal thick-walled portion 32 is thicker than the joining portion 31 and is formed to have a rectangular shape in cross-section and so as to extend in the toe-heel direction of the sole portion 3. Also, the center of gravity G of the head that is projected onto the sole portion 3 is located in this frontal thick-walled portion 32. A height F1 of the frontal thick-walled portion 32 from the undersurface of the sole portion 3 is preferably 2.5 to 8.0 mm, and is more preferably 3.0 to 8.0 mm. Also, a width F2 of the frontal thick-walled portion 32 starting from the end portion of the joining portion 31 is preferably 10 to 30 mm, and is more preferably 15 to 25 mm. The width F2 at this time is the maximum length, and is the length of the lower side when the cross-sectional shape of the frontal thick-walled portion 32 is a trapezoid, for example. Also, a ratio F2/F1 of the height F1 to the width F2 of the frontal thick-walled portion 32 is, for example, preferably 1.25 to 10.0, and more preferably 3.0 to 8.0. Note that the above dimensions F2 and Y are assumed to be measured by the length in the face-back direction in the case where the head body 10 is cut in a vertical plane passing through the above-mentioned center of the face.

The central thin-walled portion 33 that is arranged on the back side of the frontal thick-walled portion 32 is formed to have a substantially triangular shape projecting to the back side. The peripheral thick-walled portion 34 surrounding the frontal thick-walled portion 32 and the central thin-walled portion 33 is constituted by three portions in the present embodiment, but is formed to be substantially U-shaped as a whole, and the above-mentioned recessed portion 36 is arranged in a part thereof. To be more specific, the peripheral thick-walled portion 34, as a whole, extends from the toe side of the frontal thick-walled portion 32 to the back side along edge portions of the frontal thick-walled portion 32 and the central thin-walled portion 33 on the toe side, and extends via the rear end portion of the central thin-walled portion 33 on the back side to the face side along edge portions of the central thin-walled portion 33 and the frontal thick-walled portion 32 on the sole side. That is, the peripheral thick-walled portion 34 is formed to be substantially U-shaped with both end portions in the vicinity of the face portion 1, and is formed so as to generally increase in width toward to back side. Also, the peripheral thick-walled portion 34 is divided by the recessed portion 36. Furthermore, the substantially U-shaped peripheral thin-walled portion 35 is arranged on the back side of the peripheral thick-walled portion 34, so as to surround this peripheral thick-walled portion 34.

The peripheral thick-walled portion 34 is thinner than the frontal thick-walled portion 32 (the above-mentioned F1), but thicker than the central thin-walled portion 33. For example, the thickness of the central thin-walled portion 33 can be set from 0.4 to 0.8 mm. On the other hand, the thickness of the peripheral thick-walled portion 34 can be set from 1.0 to 6.0 mm. The three portions need not, however, be the same thickness, and need only be at least thicker than the central thin-walled portion 33. The bottom of the recessed portion 36 is also thicker than the thin-walled portion 33, and can be set from 0.8 to 3.0 mm, for example. Furthermore, the peripheral thin-walled portion 35 is about the same thickness as the central thin-walled portion 33, and is thinner than the peripheral thick-walled portion 34.

5. Manufacturing Method

The golf club head configured as described above can be produced with various methods, and can, for example, be manufactured in the following manner. First, the head body 10 can be manufactured by casting such as known lost wax precision casting, for example. On the other hand, the face member 20 can be manufactured by stamping. The head body 10 and the face member 20 are then joined by welding. Thereafter, the golf club head is completed by performing painting and the like.

6. Features

According to the above embodiment, the following effects can be obtained.

(1) Since the peripheral thick-walled portion 34 is formed so as to surround the central thin-walled portion 33, the lateral moment of inertia of the head can be increased. Thus, even in the case where the ball is hit at a position shifted in the toe-heel direction, variation in the hitting conditions, carry distance and directionality can be reduced. In particular, since the center of gravity is above the frontal thick-walled portion 32, the peripheral thick-walled portion 34 is located at a distance from the center of gravity, thereby enabling the lateral moment of inertia to be further increased. Also, since the peripheral thick-walled portion 34 has a width M1 on the heel side that is larger than a width M2 on the toe side, slicing is less likely (so-called ball holding is improved).

(2) The frontal thick-walled portion 32 and the peripheral thick-walled portion 34 are provided in the sole portion 3, dividing the thick part between two places. Thus, the thick-walled portions 32 and 34 are kept from becoming too thick. The center of gravity can thereby be further lowered.

(3) The peripheral thin-walled portion 35 is provided at a small thickness, around the peripheral thick-walled portion 34. Since the peripheral thick-walled portion 34 is located at a higher position than the central thin-walled portion 33 and/or the frontal thick-walled portion 32, lowering of the center of gravity can be further achieved by reducing the thickness of such parts that are positioned higher.

(4) With regard to the peripheral portion 12 of the face member 20, the width K2 of the second peripheral region 122 is larger than the width K1 of the first peripheral region 121, with the width K2 being more than 1.6 times larger. Thus, the restitution performance of the lower part of the face portion 1 can be enhanced. Carry distance can also be lengthened in cases such as hitting a ball arranged directly on the ground.

(5) As described above, the frontal thick-walled portion 32 of the sole portion 3 moves to the back side when the width K2 of the second peripheral region 122 is lengthened, possibly resulting in an increase in the SS height. In contrast, in the present embodiment, the width Y of the joining portion 31 of the sole portion 3 is set to 10 mm or less, and the dimensions of the frontal thick-walled portion 32 are furthermore prescribed as described above. In particular, when the ratio F2/F1 of the height F1 and the width F2 of the frontal thick-walled portion 32 is set from 1.25 to 10.0, it is possible to suppress an increase in the height of the center of gravity of the head and to also suppress movement of the center of gravity to the back side. As a result, an increase in the SS height can be suppressed.

7. Variations

Although one embodiment of the present invention has been described above, the invention is not limited to the foregoing embodiment, and various modifications can be made without departing from the spirit of the invention. Note that the following variations can be combined as appropriate.

7.1

In the above embodiment, the frontal thick-walled portion 32 and the peripheral thin-walled portion 35 are provided in the sole portion 3, but it is sufficient that at least the central thin-walled portion 33 and the peripheral thick-walled portion 34 surrounding the central thin-walled portion 33 are provided in the sole portion 3. Also, the weight member is not essential, in which case the recessed portion 36 is also not essential and need only be provided if necessary. Also, the peripheral thick-walled portion 34 can take various modes, and may be constituted by a plurality of portions as in the above embodiment, or may be constituted by one portion. Also, the peripheral thick-walled portion 34 need not surround the central thin-walled portion 33 continuously, and may surround the central thin-walled portion 33 intermittently. Furthermore, in the case where the recessed portion 36 is provided, the central thin-walled portion 33 may be surrounded by a combination of the peripheral thick-walled portion 34 and the recessed portion 36, provided that the recessed portion 36 is thicker than the central thin-walled portion 33.

7.2

The peripheral thick-walled portion 34 need only be formed so as to surround the central thin-walled portion 33 as a whole, and can take various shapes apart from being substantially U-shaped, such as having a sharp V-shape projecting to the back side, an arc shape, or a broken line shape. In order, however, to arrange the peripheral thick-walled portion 34 at a distance from the center of gravity, a substantially U-shape is preferable. The width of the peripheral thick-walled portion 34 can also be changed as appropriate, and apart from making the width on the heel side larger than on the toe side as in the above embodiment, the width of the peripheral thick-walled portion 34 can be generally constant as a whole, or the width of at least a part thereof may be increased toward the back side, for example.

7.3

In the above embodiment, the joining portion 31 that joins to the second peripheral region 122 is provided in the sole portion 3, and in the case of joining the head body 10 and the peripheral portion 12 of the face member 20 by welding, it is preferable to make the peripheral portion 12 and the joining portion 31 generally the same thickness. On the other hand, the frontal thick-walled portion 32 and the second peripheral region 122 can also be joined directly, without providing the joining portion 31. In such cases where the joining portion 31 is not provided, the peripheral portion 12 of the face member 20 and the end surface of the opening 61 of the head body 10 can be joined using brazing, adhesive, diffusion bonding, or the like.

7.4

The frontal thick-walled portion 32 of the sole portion 3 is not particularly limited in shape, and can take various forms such as having a rectangular shape, besides being trapezoidal in cross-section as described above.

7.5

In the above embodiment, as shown in FIG. 5, for example, the peripheral portion 12 of the face member 20 and the end surface of the opening of the head body 10 are the same in thickness, but this can also be changed. For example, the peripheral portion 12 can be made thicker than the end surface of the opening. Since the thickness of the crown portion 2 of the head body 10 thereby decreases, for example, the restitution performance can be improved.

7.6

The positional relationship of the peripheral thick-walled portion 34, the central thin-walled portion 33 and the center of gravity G can be set as follows, for example. That is, the distance (shortest distance) between the position of the center of gravity G projected onto the sole portion 3 and the peripheral thick-walled portion 34 is preferably longer than the distance (shortest distance) between the position of the center of gravity G projected onto the sole portion 3 and the central thin-walled portion 33. The lateral moment of inertia can thereby be further increased. Also, in the above embodiment, the central thin-walled portion 33 is arranged on the back side of the frontal thick-walled portion 32, and is preferably further arranged on the back side of the center of gravity G. The center of gravity G can thereby be positioned nearer the face.

7.7

In the above embodiment, a cup face structure is employed, and apart from having different widths as described above, the peripheral portion 12 of the face member 20 can be configured to have the same width. Also, rather than having a cup face structure, a structure in which a tabular face portion is fitted into the opening of the head body may be employed, for example.

7.8

The present invention can be applied to golf club heads such as drivers, fairway woods and utilities.

REFERENCE SIGNS LIST

1 Face portion
2 Crown portion
3 Sole portion
32 Frontal thick-walled portion (second thick-walled portion)
33 Central thin-walled portion (first thin-walled portion)
34 Peripheral thick-walled portion (first thick-walled portion)
35 Peripheral thin-walled portion (second thin-walled portion)

The invention claimed is:

1. A golf club head comprising:
a crown portion;
a sole portion; and
a face portion,
wherein the sole portion includes:
a first thin-walled portion;
a first thick-walled portion that extends from a toe side of the first thin-walled portion to a heel side of the first thin-walled portion via a back side, so as to surround the first thin-walled portion, and is thicker than the first thin-walled portion, and
a second thin-walled portion that is arranged on the back side of the first thick-walled portion and extends from a toe side of the first thick-walled portion to a heel side of the first thick-walled portion via the back side, so as to surround the first thick-walled portion, and is thinner than the first thick-walled portion, and wherein a width in a toe-heel direction of the first thick-walled portion is at least partially larger on the heel side than that on the toe side, wherein the sole portion further includes a second thick-walled portion arranged on the face side of the first thin-walled portion, and wherein the first thick-walled portion extends from the toe side of the second thick-walled portion to the back side via the toe side of the first thin-walled portion, and further extends from the back side to the heel side of the second thick-walled portion via the heel side of the first thin-walled portion, so as to surround the first thin-walled portion and the second thick-walled portion.

2. The golf club head according to claim 1, wherein the first thick-walled portion is at least partially larger in width on the heel side than on the toe side.

3. The golf club head according to claim 1, wherein the first thick-walled portion is formed to have a substantially U-shape projecting to the back side.

4. The golf club head according to claim 1, wherein the first thick-walled portion is higher than the first thin-walled portion.

5. The golf club head according to claim 1, wherein a length of the first thin-walled portion in a toe-heel direction is formed so as to decrease toward the back side.

6. The golf club head according to claim 1, wherein at least a part of the first thin-walled portion is placed on a placement surface in a reference state and the remaining portion of the first thin-walled portion inclines upward toward the back side.

7. The golf club head according to claim 1, wherein at least a part of the first thick-walled portion is placed on a placement surface in a reference state and the remaining portion of the first thick-walled portion inclines upward toward the back side.

8. The golf club head according to claim 1, wherein the first thick-walled portion is higher than the second thick-walled portion.

9. The golf club head according to claim 1, wherein a length of the second thick-walled portion in a toe-heel direction is formed so as to decrease toward the back side.

10. The golf club head according to claim 1, wherein at least a part of the second thin-walled portion is placed on a placement surface in a reference state and the remaining portion of the second thin-walled portion inclines upward toward the back side.

11. The golf club head according to claim 1, wherein the golf club head is constituted by assembling a head body and a face member, the head body includes the crown portion and the sole portion, and has an opening surrounded by the crown portion and the sole portion, and the face member is formed in a cup shape having the face portion which is tabular and is for hitting a ball and a peripheral portion that extends from a peripheral edge of the face portion and is joined to an end surface of the opening.

12. The golf club head according to claim 1, wherein the first thick-walled portion has arranged therein a recessed portion configured to receive a weight member.

13. A golf club head comprising:

a crown portion;

a sole portion; and a face portion, wherein the sole portion includes:

a first thin-walled portion;

a first thick-walled portion that extends from a toe side of the first thin-walled portion to a heel side of the first thin-walled portion via a back side, so as to surround the first thin-walled portion, and is thicker than the first thin-walled portion, wherein the first thick-walled portion is formed to extend toward a face side from a point on the back side, so as to spread toward both the toe side and the heel side, and a second thin-walled portion that is arranged on the back side of the first thick-walled portion and extends from a toe side of the first thick-walled portion to a heel side of the first thick-walled portion via the back side, so as to surround the first thick-walled portion, and is thinner than the first thick-walled portion, wherein a width in a toe-heel direction of the first thick-walled portion is at least partially larger on the heel side than that on the toe side, wherein the sole portion further includes a second thick-walled portion arranged on the face side of the first thin-walled portion, and wherein the first thick-walled portion extends from the toe side of the second thick-walled portion to the back side via the toe side of the first thin-walled portion, and further extends from the back side to the heel side of the second thick-walled portion via the heel side of the first thin-walled portion, so as to surround the first thin-walled portion and the second thick-walled portion.

14. The golf club head according to claim 13, wherein the first thick-walled portion has arranged therein a recessed portion configured to receive a weight member.

* * * * *